United States Patent [19]

Borbely et al.

[11] Patent Number: 5,033,242

[45] Date of Patent: Jul. 23, 1991

[54] SHUTTERING PANELS FOR USE IN FORMWORK FOR CAVITY FLOORS

[75] Inventors: György Borbely, Pöcking; Thomas Gsell, Munich, both of Fed. Rep. of Germany

[73] Assignee: Gyorgy Borbely, Pocking, Fed. Rep. of Germany

[21] Appl. No.: 432,230

[22] Filed: Nov. 6, 1989

[30] Foreign Application Priority Data

Nov. 8, 1988 [DE] Fed. Rep. of Germany ..... 3837849

[51] Int. Cl.[5] ..... E04B 9/00

[52] U.S. Cl. ..... 52/126.5; 52/126.6; 52/381; 52/410

[58] Field of Search ..... 52/126.5, 126.6, 301, 52/302, 365, 366, 381, 283, 410

[56] References Cited

U.S. PATENT DOCUMENTS

| | | | |
|---|---|---|---|
| 3,218,767 | 11/1965 | Stark | 52/381 |
| 4,348,841 | 9/1982 | Ueno et al. | 52/126.5 |
| 4,528,789 | 7/1985 | Simpson | 52/410 X |
| 4,546,580 | 10/1985 | Ueno et al. | 52/126.5 X |
| 4,707,961 | 11/1987 | Nunley et al. | 52/410 X |
| 4,719,727 | 1/1988 | Cooper et al. | 52/126.6 |
| 4,922,670 | 5/1990 | Naka et al. | 52/126.6 |

FOREIGN PATENT DOCUMENTS

| | | | |
|---|---|---|---|
| 484444 | 3/1976 | Australia | 52/126.6 |
| 199560 | 10/1986 | European Pat. Off. | 52/126.5 |
| 2811136 | 9/1979 | Fed. Rep. of Germany | 52/126.6 |
| 2915115 | 12/1979 | Fed. Rep. of Germany | 52/126.6 |
| 3103632 | 8/1982 | Fed. Rep. of Germany . | |
| 3201085 | 8/1982 | Fed. Rep. of Germany . | |
| 8404767 | 2/1984 | Fed. Rep. of Germany . | |
| 3317683 | 11/1984 | Fed. Rep. of Germany . | |
| 3434872 | 3/1986 | Fed. Rep. of Germany . | |
| 422284 | 4/1967 | Switzerland | 52/126.6 |
| 85/05397 | 12/1985 | World Int. Prop. O. | 52/126.6 |

*Primary Examiner*—Robert L. Wolfe
*Assistant Examiner*—Suzanne L. Dino
*Attorney, Agent, or Firm*—Body, Vickers & Daniels

[57] ABSTRACT

A shutter panel for use in a lost formwork for making a cavity floor. The panel has connection members for bearer feet. The connection members extend through holes in the shuttering panel. For marginal reinforcement of the panel around the holes, special fittings are provided, for example bracing plates, flanges or washers disposed against the underside of the panel. The holes in the shutter panel may also have an inside diameter such that the bearer feet can be passed through them from above at the time of fixing to fittings at the holes. The panel preferably consists of plaster.

15 Claims, 2 Drawing Sheets

SHUTTERING PANELS FOR USE IN FORMWORK FOR CAVITY FLOORS

FIELD OF THE INVENTION

This invention relates to shuttering panels for use in formwork for producing the upper floor of a cavity floor, which formwork has bearing feet for supporting it spaced from the lower floor.

BACKGROUND OF THE INVENTION

To produce formwork for the upper floors of cavity floors, it is known to use as expendable shuttering panel-like shuttering elements. Indeed, it is also known to use a synthetic plastics shuttering film provided with blocked-out portions which form the bearer feet by which the shuttering foil is supported on a lower floor. Flowable flooring composition is applied onto the shuttering film and flows into the upwardly-open bearer feet shapes, where it hardens and forms the bearer feet (German Offenlegungsschriften 31 03 632, 32 01 085, and 33 17 683). Such shuttering films with integrally moulded bearer feet, to be filled with flooring composition, are unstable to the extent that it is not possible for anyone to walk on the structure during installation. Furthermore, a variety of heights of cavity flooring cannot be produced with these shuttering films.

It is also already known to use square shuttering sheets with downwardly angled-over corners which fit into tubular bearer feet, the height of which can be adjusted by means of setscrews (German Gebrauchsmuster 84 04 767.4). The shuttering sheets or panels are provided with upwardly-angled edge parts at which they are clamped by means of special clamping sections. The cost of production and installation of a cavity floor produced by means of such shuttering sheets is relatively high. Furthermore, at the corner zones of the panels there are a large number of potential leakage points where the flooring composition can flow into the cavity of the double floor. Adjustment of the carrier feet by means of setscrews disposed at their bottom ends is difficult.

Finally, the state of the art also includes shuttering panels provided with integrally moulded hollow studs which constitute the means of connecting the vertically adjustable bearer feet (German Patent 34 34 872). The pot-shaped bearer feet are fitted frictionally in telescopic fashion on the hollow studs, with no holes on the bottom of the studs through which the flooring composition might pass. Pouring the flooring composition into the bearer feet is problematical since any enclosed air cannot escape. Thus the stability of the upper floor is questionable.

SUMMARY OF THE INVENTION

The object of the invention is to provide, for the production of cavity floors, a form shuttering panel of the type having connections for bearer feet, which can be produced inexpensively while having a sufficiently great structural strength and which can, if required, also permit negotiation of the construction while the shuttering is being laid. Desirably it should be adaptable so that cavity floors of variable height, and/or where the bearer feet may be adapted to an uneven sub-floor, can be produced without excessive installation costs.

According to the invention, this is achieved in connection members for the bearer feet pass through holes in the shuttering board and in that the shuttering board is provided with fittings which strengthen it in the area around the holes. Preferably, the shuttering board is made from a non-metallic material, most preferably, a pre-perforated mineral panel, particularly a gypsum or fibrous cement panel or the like, while the connection members, fittings and/or bearer feet are expediently metal elements, steel tubes being advantageously used for the bearer feet. The said reinforcing fittings may also be a constituent part of the connecting members or of the bearer feet themselves.

A shutter panel or formwork embodying the invention may, without the boards being excessively thick, be produced from comparatively inexpensive materials of the aforesaid type. Adjustment of the height of the hollow or cavity floor may be provided for by the length of the bearer feet which can be connected to or fitted on the connecting members, or by the mode of connection to the connection members. Reinforcement of the shuttering panel in the area around its holes provides reliable connection of the bearer feet to the shuttering panel and furthermore a secure absorption and transmission of force to the sub-floor without the bearer feet first having to acquire their supporting capacity by being filled with flooring composition or some other flowable and hardenable compound. If filling of the bearer feet is dispensed with, then there are no problems in connection with the dispersal of any air trapped in the bearer feet. Thus, it may be possible to achieve not inconsiderable savings in terms of the relatively expensive flooring compound.

The said fittings preferably comprise or consist of support plates which engage the panel surface around the through-holes, e.g. under the holes in the panel. The support plates may consist of simple washers or the like which are provided with apertures through which the bearer feet or their connection members can pass. They may also consist of flanges on the bearer feet or their connection members. If the plates are not flanges on the bearer feet, it is advisable to connect the bracing plates to the shuttering panel. This may be, for instance, by adhesion or by a mechanical engagement e.g. claw attachment.

In one preferred aspect, the connection members comprise coupling studs which pass through the holes in the shuttering board and project downwardly from the holes, and onto which it is possible to fit hollow bearer feet of whatever length is required, preferably with the bearer feet butted against the periphery of the hole on the underside of the shutter panel. This abutment may be e.g. via a flange of the bearer foot, or against a washer as aforesaid which engages around the hole in the panel. The coupling stud may be fitted loosely from above into the relevant hole in the shuttering board. Expediently it has a head flange or the like bearing on the panel upper surface, and a fixed connection of the coupling stud to the panel may be provided, e.g. by adhesion, claw attachment or by any other means, although it is not absolutely necessary. The coupling stud may instead comprise a (preferably slotted) clamping sleeve which fits with a clamping action in the hole in the shutter panel so that its clamping effect secures it into the panel. Preferably, the coupling stud is a hollow stud closed at the bottom.

In a particularly preferred feature, the holes in the panel have a diameter such that the bearer feet can be passed through them from above. This makes it possible when laying the panels to pass the bearer feet through them from above and to fix them in the appropriate position, which means a substantial simplification of the installation work and which may also make it possible for the height of the bearer feet e.g. in the case of an uneven sub-floor, to be adjusted subsequently from the top of the shuttering. Particularly when this feature is used it is preferred to dispose in the holes coupling sleeves or the like which serve to connect the bearer feet and which at the same time may comprise a bracing flange which forms the support plate. Such sleeve-like coupling members can be used to secure the bearer feet in various ways preferably with variability of height. For example, in one preferred version the coupling sleeves are provided with a screwthread for an adjusting nut which carries the vertically adjustable bearer foot and to which the bearer foot is advantageously connected by means of a rotary connection. The adjusting nut expediently has an upwardly-open internal polygonal aperture into which it is possible to fit a key to actuate the adjusting nut.

In an alternative arrangement using a coupling sleeve, the bearer foot is fitted into the sleeve mounted on the panel and is fixed therein, for instance by a simple crimped connection, by spot welding, by bolting or the like.

It is preferred, after laying the panels to provide a formwork, to cover them with a synthetic plastics film onto which then the flooring composition or some other flowable and hardenable compound is applied. The synthetic plastics film prevents the flooring composition penetrating the joints between the panels and potentially passing into the bearer feet or their connection means. That is, it forms a cover for the formwork.

The invention will be explained in greater detail hereinafter by reference to preferred embodiments shown in the accompanying drawings, in which:

DETAILED DESCRIPTION OF THE PREFERRED EMBODIMENTS

Figure 1:
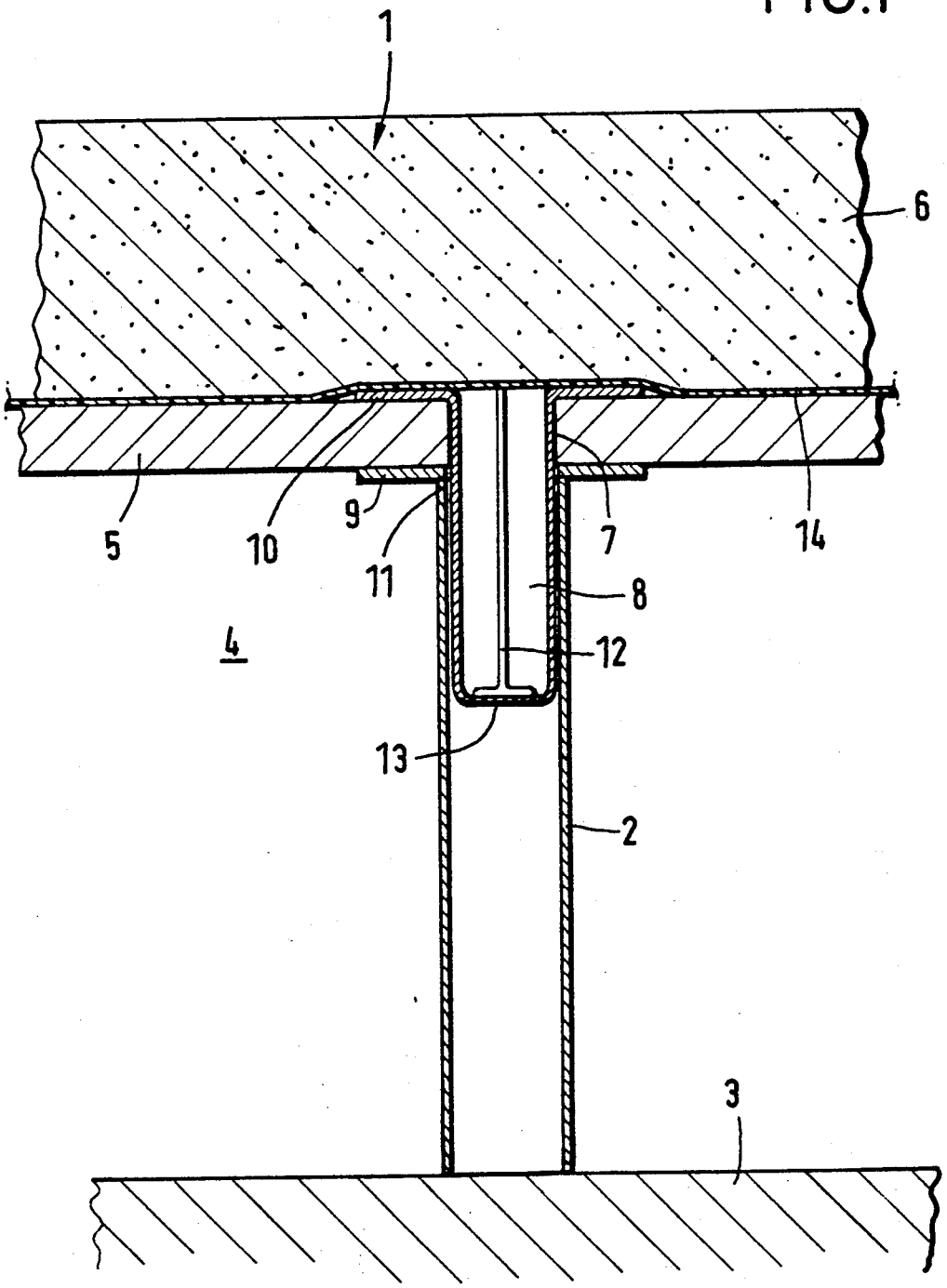
FIG. 1 is a vertical section through a cavity floor showing a shuttering panel embodying the invention in a detail in the region of one of its bearer feet.

The cavity floor shown in FIG. 1 consists of an upper floor 1 supported by prefabricated bearer feet 2 on a lower floor 3 forming for example, the crude concrete floor of a building. The cavity 4 may be used e.g. as an installation space for laying pipes and cables, for the installation of underfloor heating or for air conditioning. The upper floor or cavity floor 1 is produced by the use of an expendable shuttering or lost formwork consisting of individual preferably rectangular or square shuttering panels 5 which are spaced apart from the lower floor 3 by means of bearer feet 2. Then, a flowable and hardenable composition, generally a flooring composition 6, is to be applied onto the resulting shuttered formwork as shown.

The individual shutter panels 5 are, for example, 1000×1000 mm in size. Preferably they consist of plaster board panel elements. Each has a plurality of rows of holes 7, the distance between the holes within each row and the gap between the rows being, for example, 250 mm. At each hole 7 the panel 5 is provided with a connection member 8 for a bearer foot 2. Furthermore, in the region of the holes 7, the shuttering board 5 comprises reinforcement parts or fittings 9.

In the case of embodiment shown in FIG. 1, the fitting 9 consists of a support plate in the form of a washer which engages the under-surface of the panel 5 in the region of the respective hole and has an aperture to accommodate the top of the tubular steel bearer foot 2. The washer 9 is ideally rigidly connected, for example by glueing and/or claw attachment, to the panel 5; this is not shown in detail in FIG. 1. With a claw attachment, the washer 9 is provided with suitable claws which are pressed or driven into the panel under-surface.

In the case of the embodiment shown in FIG. 1, the connection member 8 for the bearer foot 2 consists of a hollow cylindrical coupling stud which extends through the hole 7, projecting downwardly by a relatively considerable distance from the hole 7. The coupling stud 8 has, bearing from above against the shuttering board 5, a head flange 10 which likewise constitutes a marginal reinforcement of the panel element 5 in the region of the hole. The tubular bearer foot 2 is fitted onto the coupling stud 8 from below, being centred by this latter and supported in a transverse sense. The bearer foot 2 has its upper end 11 abutting against the washer 9.

The coupling stud 8 may also have its head flange 10 fixed to the shuttering board 5, for example by glueing and/or claw attachment, although this is not absolutely necessary. It may be constructed so that it can serve as a clamping sleeve and fit with a certain wedging or interference effect in the hole 7 in the shutter panel. In this respect, it is possible to construct the coupling stud 8 as a longitudinally slotted clamping sleeve. Such a longitudinal slot is indicated at 12 in FIG. 1.

The coupling stud 8 is closed at its bottom end 13. After the individual panels 5 have been laid, it is a good idea to place over the finished shuttering a synthetic plastics film 14 which covers the joints between the shuttering boards 5 and also the connection areas of the bearer feet 2 so that the flooring composition 6 which is subsequently applied does not flow into the joints or into the coupling studs 8 and the bearer feet 2.

It will be appreciated that the length(s) of the bearer feet 2 will depend on the height(s) of the cavity 4, so the shuttering panels 5 may be fitted with bearer feet 2 of different lengths. For the bearer feet 2, it is ideal to use steel tubes. The connection members 8 and the reinforcing fitting parts 9 are also expediently made from metal e.g. steel.

It is evident that in this embodiment the load resting on the panels of the formwork or on the cavity floor is, via the washers 9, spread over a relatively large area onto the bearer feet 2 and thence to the underfloor 3. Instead of the washers 9, the bearer feet 2 may carry at their upper ends integrally-formed flange plates which are applied against the underside of the shuttering 5, supporting substantial areas of the panel element around the holes 7.

Figure 2:
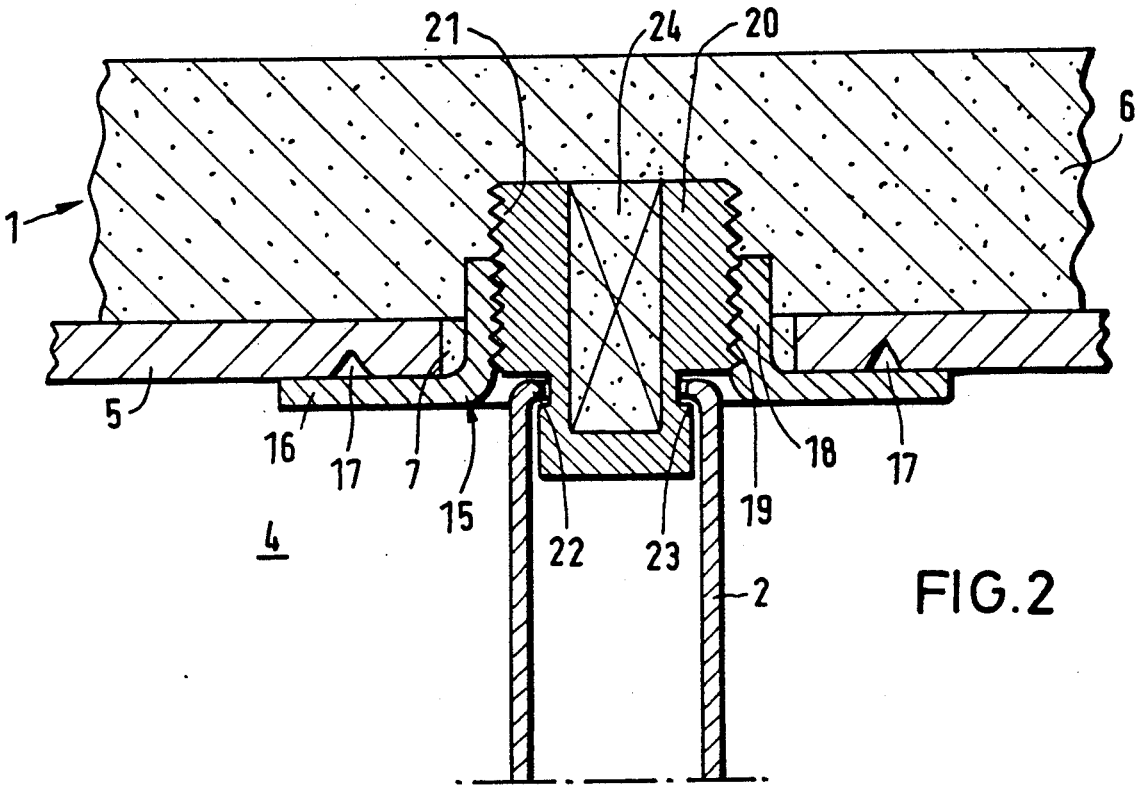
FIGS. 2 and 3 show in a sectional view as in FIG. 1 respectively two further advantageous developments of the shuttering board embodying the invention.
Figure 3:
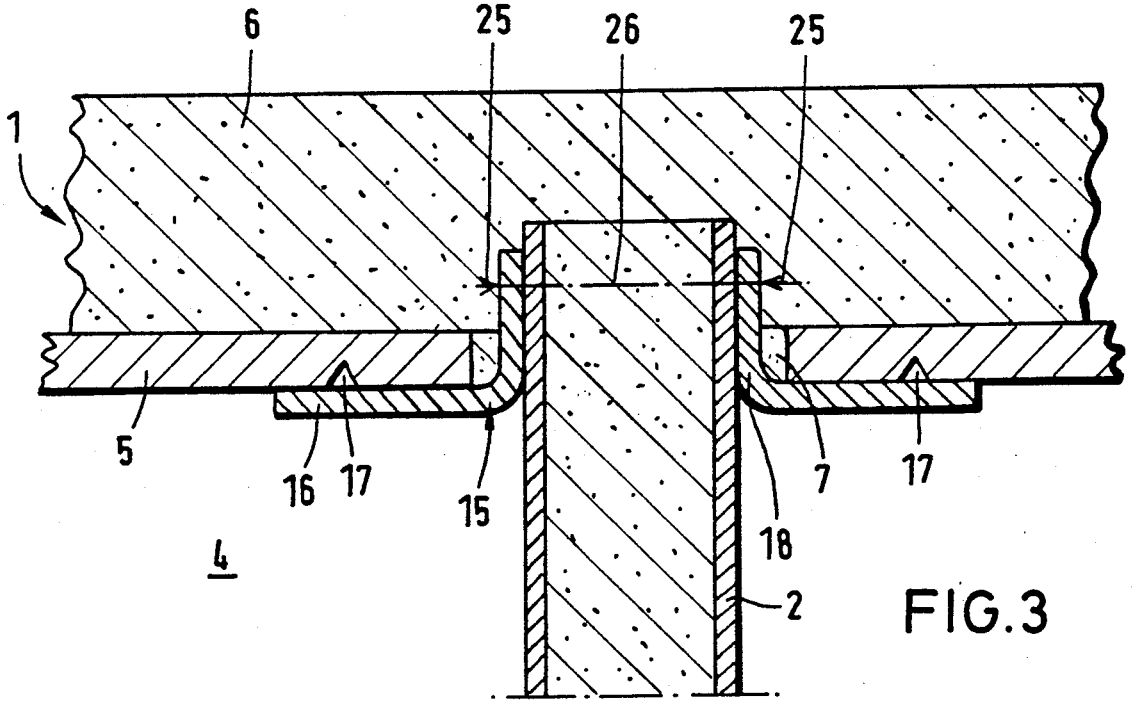

FIGS. 2 and 3 show two further conformations of panels and formwork embodying the invention, in which the holes 7 in the plaster panel 5 have in each case an inside diameter such that the bearer feet 2 can be passed through these holes from above. At the same time, it is possible to fit into each hole 7 in the shuttering panel 5 a sleeve e.g. coupling sleeve 15 which has as a fitting a support flange 16 engaging around the panel 5 in the area of the hole periphery and which performs the same function as the washer 9 in FIG. 1. The coupling sleeve 15 is rotationally rigid on the panel 5. This can be achieved, for example, by glueing and/or by claw attachment. FIG. 2 shows, disposed on the flange 16, claws 17 which are driven into the panel 5. The sleeve-like collar 18 of the coupling sleeve 15 which engages through the hole 7 comprises an internal screwthread into which a plug-like adjusting nut 21 can be screwed by engagement with an external screwthread 20 thereof. The bearer foot 2 is connected to this nut 21. The connection is expediently performed by a rotary joint, e.g. in that, as FIG. 2 shows, the upper end 22 of the tubular bearer foot 2 is flanged-over into an annular groove 23 of the adjusting nut 21 so that the two parts can rotate relative to one another. The adjusting nut 21 comprises a blind square hole 24 into which it is possible to fit a key from above, so that the adjusting nut 21 can be screwed into or out of the coupling sleeve 15. By means of the adjusting nut 21, it is also possible to set the height of and adjust the supporting foot 2, e.g. for an uneven subfloor 3. The adjusting nut 21 also seals the hole 7 when the flooring composition 6 is subsequently poured into it.

In the embodiment shown in FIG. 3, adjustment of the height and fixing of the bearer foot 2 by means of an adjusting nut is dispensed with. The tubular bearer foot 2 fits directly into the coupling sleeve 15 fixed in the panel 5, and is fixed therein at the desired height. This can be achieved, for instance, by a crimped joint in which the neck piece 18 of the coupling sleeve, as indicated schematically by arrows at 25 in FIG. 3, is pressed or crimped inwardly so that the bearer foot 2 is rigidly clamped. Alternatively or additionally, fixing may be achieved at 25 by spot welding or by bolting, e.g. a bolt indicated schematically in FIG. 3 by the dotted line 26 is passed through aligned bolt holes in the coupling sleeve and bearer foot 2 and then secured.

Particularly in the embodiment according to FIG. 3 it may be advisable to close off the top ends of the tubular bearer feet 2 in order to avoid flooring composition flowing into them. This can be done by fitting a plug or the like. The bearer feet 2 may also if desired be closed at their bottom ends, for example by means of a plug.

In the case of the embodiment shown in FIG. 2, the bearer feet 2 may instead be rigidly connected to the adjusting nuts 20, for example by a welded connection. The skilled man will appreciate that numerous variations on the illustrated embodiments are possible.

In any case, the shuttering panel element should consist of a hard layer material, preferably a plaster panel as aforesaid. In the version shown in FIGS. 2 and 3, the joints may be sealed by a synthetic plastic film being placed over the shuttering panels 5 and this may if desired be provided with apertures or blocked-out configurations at the connecting members for the bearer feet 2.

I claim:

1. A lost formwork construction for use in forming an upper floor, which construction comprises:

at least one panel element having through-holes;

bearer feet for supporting the at least one panel element and the upper floor when formed having a bearer feet cross-sectional size;

a plurality of connection members for connecting the at least one panel element to the bearer feet, each of said connection members extending through a respective one of the through-holes and having a central aperture having a connection member aperture cross-sectional size;

reinforcing parts, each of said reinforcing parts being fitted to an area of panel element around a respective through-hole to reinforce the panel element at that area; and, said connection member aperture cross-sectional size being larger than said bearer feet cross-sectional size whereby said bearer feet can be completely passed through said connection members and adjusted from above for connection with said connection members.

2. A construction as claimed in claim 1 in which the panel element consists of a mineral substance.

3. A construction as claimed in claim 1 in which each panel element is a pre-perforated plaster panel.

4. A construction as claimed in claim 1 in which the reinforcing parts are metal.

5. A construction as claimed in claim 1 in which the bearer feet are metal tubes.

6. A construction as claimed in claim 1 in which the reinforcing parts are formed integrally in one piece with the respective connection members.

7. A construction as claimed in claim 6 in which the reinforcing parts consist of integral flanges on the connection members extending radially therefrom to engage the panel element under-surface.

8. A construction as claimed in claim 1 in which the reinforcing parts are formed integrally with the bearer feet.

9. A construction as claimed in claim 1 in which each connection member comprises a coupling sleeve in the through-hole.

10. A construction as claimed in claim 9 in which the bearer foot extends into and is secured into the coupling sleeve.

11. A construction as claimed in claim 9 in which each connection member further comprises a nut screwthreadedly engageable in the coupling sleeve, said nut carrying the bearer foot which is thereby vertically adjustable by rotation of the nut relative to the sleeve.

12. A construction as claimed in claim 11 in which the reinforcing part comprises a flange formed integrally with the coupling sleeve and extending radially therefrom, the flange engaging the panel element under-surface so as to be fixed against rotation relative thereto.

13. A construction as claimed in claim 11 in which the bearer foot is rotatable relative to the nut.

14. A construction as claimed in claim 1 in which the bearer feet can be passed through the through-holes for connection.

15. A lost formwork construction as claimed in claim 1 which comprises a plurality of said panel elements with said bearer feet being secured thereto by means of said connection members, and further comprising a synthetic plastics film forming a covering of the formwork.

* * * * *